US011164557B2

(12) United States Patent
Jain

(10) Patent No.: US 11,164,557 B2
(45) Date of Patent: Nov. 2, 2021

(54) ACTIVE NOISE CANCELLATION SYSTEMS WITH CONVERGENCE DETECTION

(71) Applicant: Bose Corporation, Framingham, MA (US)

(72) Inventor: Ankita D. Jain, Westborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/683,539

(22) Filed: Nov. 14, 2019

(65) Prior Publication Data

US 2021/0151026 A1 May 20, 2021

(51) Int. Cl.

| | |
|---|---|
| ***G10K 11/178*** | (2006.01) |
| ***G10K 11/00*** | (2006.01) |
| ***G10L 21/0208*** | (2013.01) |

(52) U.S. Cl.

CPC ..... *G10K 11/1787* (2018.01); *G10K 11/002* (2013.01); *G10L 21/0208* (2013.01); *G10L 2021/02082* (2013.01)

(58) Field of Classification Search

CPC ..... G10K 11/1787; G10K 11/002; G10K 2210/1282; G10K 2210/128; G10K 11/17854; G10K 2210/12; G10L 21/0208; G10L 2021/02082

USPC ..... 381/71.1, 71.3–71.4, 71.6, 71.11

See application file for complete search history.

(56) References Cited

U.S. PATENT DOCUMENTS

| | | | | |
|---|---|---|---|---|
| 8,565,443 | B2 | 10/2013 | Wurm | |
| 9,379,751 | B2 * | 6/2016 | Liu | H04B 1/12 |
| 9,870,763 | B1 | 1/2018 | Christian | |
| 10,586,524 | B1 * | 3/2020 | Jain | G01R 21/133 |
| 10,714,116 | B2 * | 7/2020 | Tintor | G06T 7/70 |
| 2010/0014685 | A1 | 1/2010 | Wurm | |
| 2015/0010163 | A1 * | 1/2015 | Ganeshkumar | H04R 3/002 381/71.4 |

(Continued)

FOREIGN PATENT DOCUMENTS

| | | |
|---|---|---|
| WO | WO 2003/015074 | 2/2003 |
| WO | WO 2019/106077 | 6/2019 |

OTHER PUBLICATIONS

PCT International Search Report and Written Opinion in International Appln. No. PCT/US2020/060427, dated Mar. 4, 2021, 14 pages.

*Primary Examiner* — Disler Paul
(74) *Attorney, Agent, or Firm* — Fish & Richardson P.C.

(57) ABSTRACT

An input signal representative of an undesired acoustic noise in a region is captured by one or more first sensors and processed to generate a cancellation signal. An output signal is generated based on the cancelation signal to cause one or more acoustic transducers to cancel, at least in part, the undesired acoustic noise in the region. A feedback signal representative of residual acoustic noise in the region is captured by one or more second sensors. A characteristic of each of the feedback signal, the cancellation signal, and a combination of the cancellation signal and the feedback signal is determined. One or more thresholds are compared to a ratio of (i) the characteristic of the combination of the cancellation signal and the feedback signal and (ii) a combination of the characteristic of the feedback signal and the characteristic of the cancellation signal to determine a convergence state.

17 Claims, 10 Drawing Sheets

(56) References Cited

U.S. PATENT DOCUMENTS

| | | | | |
|---|---|---|---|---|
| 2016/0300562 | A1* | 10/2016 | Goldstein | G10K 11/17881 |
| 2018/0240452 | A1* | 8/2018 | Every | G10K 11/178 |
| 2020/0357377 | A1* | 11/2020 | Bastyr | G10K 11/17833 |
| 2020/0365133 | A1* | 11/2020 | Pignier | G10K 11/17817 |

* cited by examiner

ACTIVE NOISE CANCELLATION SYSTEMS WITH CONVERGENCE DETECTION

TECHNICAL FIELD

This disclosure generally relates to detecting the convergence of coefficients of an adaptive filter, for example, while performing acoustic noise cancellation.

BACKGROUND

The perceived quality of music or speech in an environment may be degraded by variable acoustic noise present in the environment. For example, when the environment is a moving vehicle, noise may result from, and be dependent upon, vehicle speed, road condition, weather, and the condition of the vehicle. The presence of noise may hide soft sounds of interest and lessen the fidelity of music or the intelligibility of speech.

Adaptive filters can generate acoustic outputs configured to destructively interfere with a noise signal, for example, to reduce the noise perceived by a user in a moving vehicle. This is sometimes referred to as noise cancellation or active noise cancellation (ANC).

SUMMARY

This document describes technology that enables detection of a converged state for the coefficients of an adaptive filter, e.g., in an active noise cancellation (ANC) system. In some cases, an absolute measure of convergence can be obtained by measuring noise cancellation at a target location. However, in some cases, measurements of the noise cancellation may be unavailable. For example, it may not be possible to simultaneously measure signals in an on-state of the ANC system and an off-state of the ANC system. In such cases, the technology described herein utilizes prediction of the noise cancellation at the target location and an asymptotic relationship between the power spectral densities (PSDs) of a cancellation signal and a feedback signal to detect when the coefficients of the adaptive filter have sufficiently converged. The technique described can be used to inform an ANC system that a "good" state (e.g., a converged state) has been achieved, in which the system is stable and noise cancellation is effectively performed. In response to detecting a converged state, the values of the coefficients of the adaptive filter may be stored for later use.

This technology may provide advantages such as reducing the time and/or processing consumed by the ANC system to achieve a converged state. This technology may also provide the advantage of quickly restoring the ANC system to a "good" state in scenarios where the ANC system may go unstable. In some cases, the technology described here can be combined with other systems such as a divergence detector to further improve performance of the ANC system.

In general, in an aspect, a method includes receiving an input signal captured by one or more first sensors, the input signal representative of an undesired acoustic noise in a region, processing the input signal, using one or more processing devices, to generate a cancellation signal, generating, based on the cancellation signal, an output signal for one or more acoustic transducers, the output signal configured to cause the acoustic transducers to cancel, at least in part, the undesired acoustic noise in the region, receiving a feedback signal captured by one or more second sensors in vicinity of the region, the feedback signal at least in part representative of residual acoustic noise in the region, determining a characteristic of the feedback signal, determining a characteristic of the cancellation signal, determining a characteristic of a combination of the cancellation signal and the feedback signal, and comparing one or more thresholds to a ratio of (i) the characteristic of the combination of the cancellation signal and the feedback signal and (ii) a combination of the characteristic of the feedback signal and the characteristic of the cancellation signal, the comparison determining a convergence state.

Implementations may include one or a combination of two or more of the following features. The method may include applying an adaptive filter to the input signal to generate the cancellation signal. Responsive to determining the convergence state, coefficients of the adaptive filter may be stored. Generating the cancellation signal may include estimating a transfer function from the one or more acoustic transducers to a user's ear. Any of the characteristic of the combination of the cancellation signal and the feedback signal, the characteristic of the feedback signal, or the characteristic of the cancellation signal may be a power spectral density. The one or more first sensors may be accelerometers. The one or more first sensors and the one or more second sensors may be disposed at a vehicle. The feedback signal may include an audio signal component representative of music or speech.

In general, in an aspect, an active noise cancellation (ANC) system includes one or more first sensors configured to generate an input signal, the input signal representative of an undesired acoustic noise in a region, one or more acoustic transducers configured to generate output audio, one or more second sensors configured to generate a feedback signal, the feedback signal at least in part representative of residual acoustic noise in the region, and a controller including one or more processing devices. The controller may be configured to process the input signal to generate a cancellation signal, generate, based on the cancellation signal, an output signal for the one or more acoustic transducers, the output signal configured to cause the acoustic transducers to cancel, at least in part, the undesired acoustic noise in the region, determine a characteristic of the feedback signal, determine a characteristic of the cancellation signal, determine a characteristic of a combination of the cancellation signal and the feedback signal, and compare one or more thresholds to a ratio of (i) the characteristic of the combination of the cancellation signal and the feedback signal and (ii) a combination of the characteristic of the feedback signal and the characteristic of the cancellation signal, the comparison determining a convergence state of the ANC system.

Implementations may include one or a combination of two or more of the following features. The ANC system may include an adaptive filter, and generating the cancellation signal may include applying the adaptive filter to the input signal. The ANC system may include a storage device, and the controller may be further configured to store coefficients of the adaptive filter responsive to determining the convergence state of the ANC system. Generating the cancellation signal may include estimating a transfer function from the one or more acoustic transducers to a user's ear. Any of the characteristic of the combination of the cancellation signal and the feedback signal, the characteristic of the feedback signal, or the characteristic of the cancellation signal may be a power spectral density. The ANC system may be implemented in a vehicle. The feedback signal may include an audio signal component representative of music or speech.

In general, in an aspect, one or more machine-readable storage devices may include computer readable instructions for causing one or more processing devices to perform operations including receiving an input signal captured by one or more first sensors, the input signal representative of an undesired acoustic noise in a region, processing the input signal, using one or more processing devices, to generate a cancellation signal, generating, based on the cancellation signal, an output signal for one or more acoustic transducers, the output signal configured to cause the acoustic transducers to cancel, at least in part, the undesired acoustic noise in the region, receiving a feedback signal captured by one or more second sensors in vicinity of the region, the feedback signal at least in part representative of residual acoustic noise in the region, determining a characteristic of the feedback signal, determining a characteristic of the cancellation signal, determining a characteristic of a combination of the cancellation signal and the feedback signal, and comparing one or more thresholds to a ratio of (i) the characteristic of the combination of the cancellation signal and the feedback signal and (ii) a combination of the characteristic of the feedback signal and the characteristic of the cancellation signal, the comparison determining a convergence state.

Implementations may include one or a combination of two or more of the following features. The one or more machine-readable storage devices may include computer readable instructions for causing the one or more processing devices to perform operations include applying an adaptive filter to the input signal to generate the cancellation signal. Generating the cancellation signal may include estimating a transfer function from the one or more acoustic transducers to a user's ear. Any of the characteristic of the combination of the cancellation signal and the feedback signal, the characteristic of the feedback signal, or the characteristic of the cancellation signal may be a power spectral density. The one or more first sensors may be disposed outside of a cabin of the vehicle.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

Figure 1:
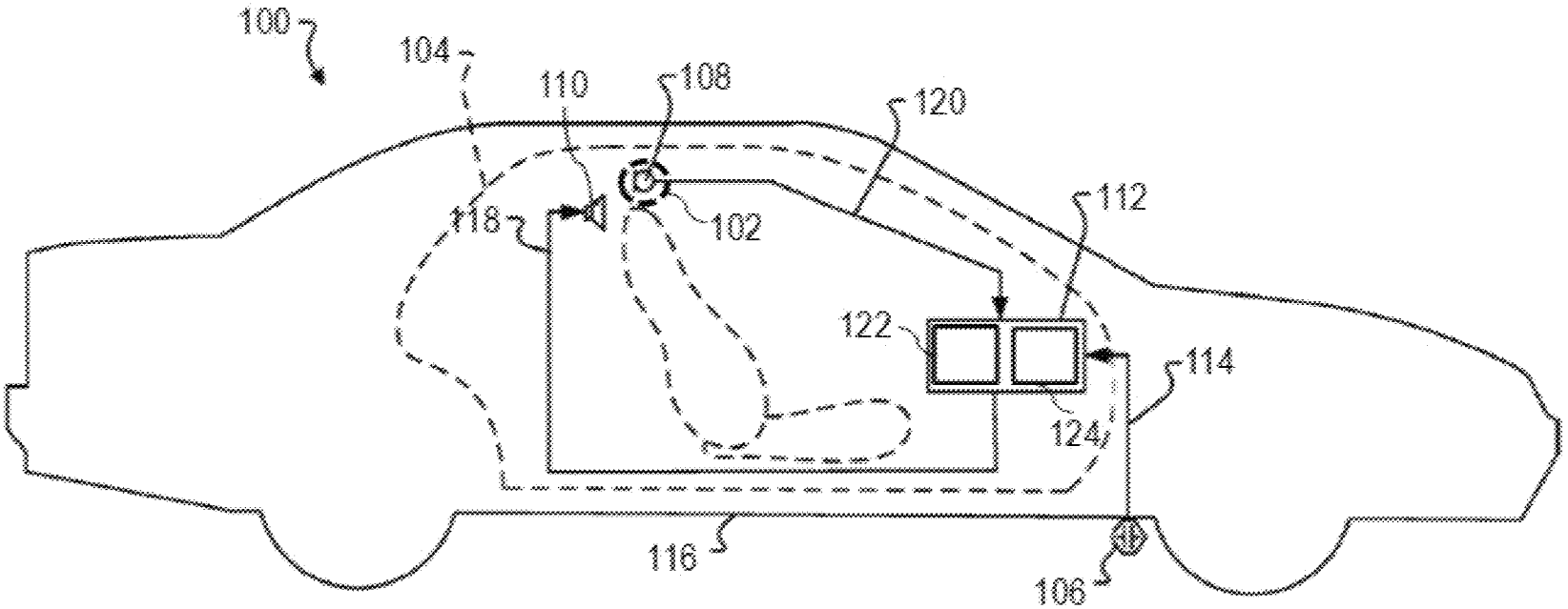
FIG. 1 is a schematic of an example vehicle with an active noise cancellation (ANC) system.

This document describes an active noise cancellation (ANC) system that is capable of detecting when the coefficients of one or more of its adaptive system identification filters have converged. Adaptive system identification filters (sometimes referred to here as "adaptive filters") can be considered digital filters having coefficients that can be dynamically adjusted, and in some cases, can converge to a set of values that represent the transfer function of a given system. In some cases, it can be challenging to determine when the coefficients of an adaptive system identification filter have converged. For example, the coefficients may change at different rates and, in noise cancellation applications, a noise signal may never be completely canceled. Furthermore, in some cases, simultaneous measurements of signals in an on- and off-state of the ANC system may not be available for comparison. For example, if the ANC system is always on, simultaneous measurements of an off-state signal may not be available. The technology described herein addresses the detection of a converged state of the coefficients of an adaptive system identification filter. The technology described herein may provide further advantages including saving the coefficients for future use, e.g., to mitigate instabilities and to reduce processing requirements of the ANC system. The technology described herein may also be combined with other systems and techniques such as divergence detection to provide more detailed information about the state of an ANC system.

In some cases, adaptive filters are used to generate a signal that destructively interferes with another signal traversing a signal pathway represented by a transfer function of the system, which may be unknown, thereby reducing the effects of the latter signal. For example, in an ANC system, the generated signal can be an acoustic signal configured to be substantially similar in magnitude, but of opposite phase as an undesirable noise signal such that a combination of the two signals produces a resulting waveform with decreased magnitude. As a result, the generated acoustic signal destructively interferes with the noise signal such that a user perceives a reduced level of the undesired noise. This may be referred to herein as noise cancellation.

ANC systems can be implemented in a wide range of environments to reduce the level of undesired noise perceived by a user of the ANC system. For example, referring to FIG. 1, an ANC system 100 may be implemented in a vehicle 116 to cancel road noise. In some cases, this may be referred to as road noise cancellation (RNC). ANC system 100 may be configured to destructively interfere with undesired sound in at least one cancellation zone 102 (e.g., near a passenger's head) within a predefined volume 104, such as a vehicle cabin. In some cases, the cancellation zone 102 may be referred to as a target location. At a high level, an example of ANC system 100 may include a reference sensor 106 (e.g., an accelerometer), a feedback sensor 108 (e.g., a microphone), an acoustic transducer 110, and a controller 112.

In an example, the reference sensor 106 is configured to generate reference sensor signal(s) representative of the undesired sound, or a source of the undesired sound, within the predefined volume 104. For example, as shown in FIG. 1, the reference sensor 106 may include an accelerometer, or a plurality of accelerometers, mounted to and configured to detect vibrations transmitted through a structure of a vehicle 116. In some cases, the reference sensor 106 may be disposed outside of the vehicle cabin. Vibrations transmitted through the structure of the vehicle 116 are transduced by the structure into undesired sound in the vehicle cabin (perceived as road noise), thus an accelerometer mounted to the structure may provide a signal representative of the undesired sound. In some cases, the signal provided by the reference sensor 106 (e.g., accelerometer) can be referred to as a reference signal 114.

The acoustic transducer 110 (also referred to herein as driver 110 or speaker 110) may include, for example, one or more speakers distributed in discrete locations within the predefined volume 104. In an example, four or more speakers may be disposed within a vehicle cabin, each of the four speakers being located within a respective door of the vehicle and configured to project sound into the vehicle cabin. In alternate examples, speakers may be located within a headrest or in the rear deck of the vehicle, or elsewhere in the vehicle cabin.

A driver signal 118 may be generated by the controller 112 and provided to one or more of the acoustic transducers 110 (e.g., drivers or speakers) in the predefined volume 104, which transduce the driver signal 118 to acoustic energy (i.e., sound waves). The acoustic energy produced as a result of driver signal 118 is approximately 180° out of phase with—and thus destructively interferes with—the undesired sound within the cancellation zone 102. The combination of sound waves generated from the driver signal 118 and the undesired noise in the predefined volume 104 results in cancellation of the undesired noise, as perceived by a listener in the cancellation zone 102. As a result, in some cases, the driver signal 118 may be referred to as a noise cancellation signal.

Because noise-cancellation cannot be equal throughout the entire predefined volume 104, the road-noise cancellation system 100 is configured to create the greatest noise-cancellation within one or more predefined cancellation zones 102, or target locations, within the predefined volume. The noise-cancellation within the cancellation zones 102 may affect a reduction in undesired sound by approximately 3 decibels (dB) or more (although in varying examples, different amounts of noise-cancellation may occur). Furthermore, the noise-cancellation may cancel sounds in a range of frequencies, such as frequencies less than approximately 350 Hz (although other ranges are possible).

The feedback sensor 108 disposed within the predefined volume 104 may generate a feedback signal 120 based on detection of residual noise resulting from the combination of the sound waves generated from the driver signal 118, the undesired sound in the cancellation zone 102, and any desired acoustic signals present in the cancellation zone 102. In this way, the feedback signal 120 represents residual noise uncancelled by the ANC system 100, and the feedback signal may be provided to the controller 112 as feedback. The feedback sensor 108 may include, for example, at least one microphone mounted within a vehicle cabin (e.g., in the roof, headrests, pillars, or elsewhere within the cabin). In some cases, as shown in FIG. 1, the feedback sensor 108 may include a microphone located near the position of a passenger's ear while sitting in the vehicle cabin.

It should be noted that the cancellation zone(s) 102 may be positioned remotely from the feedback sensor 108 (e.g., microphone). In this case, the feedback signal 120 may be filtered to represent an estimate of the residual noise in the cancellation zone(s) (e.g., a residual noise perceived at a user's ear). Furthermore, the feedback signal 120 may be formed from an array of feedback sensors 108 (e.g., microphones), and/or other signals, in order to generate an estimate of residual noise in a cancellation zone which may be remote from one or more of the array of feedback sensors. Indeed, it should be understood that any given feedback signal 120, as used in this application, may be directly received from one or more feedback sensors 108 (e.g. microphones) or may be the result of some filtering applied to the feedback signal(s) 120 received from the one or more feedback sensors and/or other signals. Regardless of the number of feedback sensors used, or the filtering applied to the feedback signal 120, in the ANC context, an error signal will be understood to represent residual undesired noise in the cancellation zone.

In an example, controller 112 may include a non-transitory storage medium 122 and a processor 124. In an example, the non-transitory storage medium 122 may store program code that, when executed by the processor 124, implements the noise-cancellation and convergence detection systems, techniques, etc. described here. The controller 112 may be implemented in hardware and/or software. For example, the controller 112 may be implemented by a SHARC floating-point DSP, but it should be understood that the controller 112 may be implemented by any other processor, FPGA, ASIC, or other suitable hardware.

Figure 2:
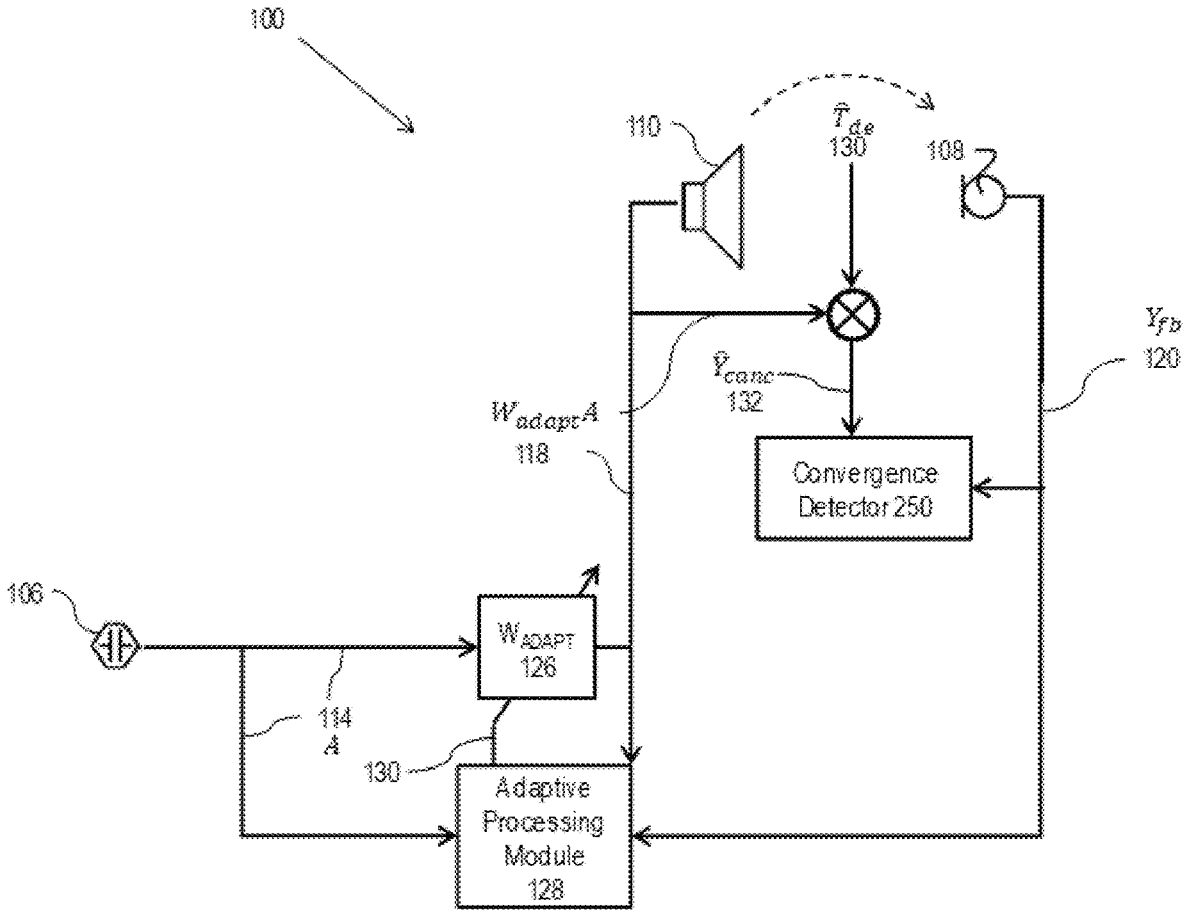
FIG. 2 is a diagram of an example single-input single-output (SISO) ANC system.

FIG. 2 shows a block diagram of the ANC system 100 from FIG. 1. As described above, the reference sensor 106 (e.g., accelerometer) is configured to capture a signal representative of undesired road noise, referred to here as reference signal A (114). The reference signal 114 is then sent to an adaptive processing module 128 of an adaptive filter. In some cases, the adaptive filter, including the adaptive processing module 128 and the filter coefficients $W_{adapt}$ (126), may be implemented by a controller (e.g., controller 112). The adaptive processing module 128 also receives a feedback signal $Y_{fb}$ (120) captured by the feedback sensor 108 (e.g., microphone) and can use the combination of the reference signal 114 and the feedback signal 120 to adjust the filter coefficients $W_{adapt}$ (126) of the adaptive filter. The adaptive processing module 128 may also receive the driver signal 118 to adjust the filter coefficients $W_{adapt}$ (126) of the adaptive filter. Adjusting the filter coefficients 126 based on the reference signal 114, the feedback signal 120, and/or the driver signal 118 can be performed using a variety of adaptive filter algorithms including least mean squares (LMS) filters, normalized least mean squares (NLMS) filters, and filtered-x least mean squares (FXLMS) filters, or combinations of them, among others. Once the filter coefficients 126 have been adjusted, the adjusted filter coefficients 126 are combined with the reference signal 114 (e.g., by multiplication in the frequency domain, convolution in the time domain, etc.) to generate the driver signal $W_{adapt}A$ (118), which is sent to the acoustic transducer 110. The acoustic transducer 110 may be a loudspeaker that is driven by the driver signal 118 to output audio into the vehicle cabin 104. This audio may in turn be captured by the feedback sensor 108 (e.g., microphone), along with other sounds such as road noise, to generate the feedback signal 120. For example, in the ANC setting, the adaptive filter algorithms may be implemented such that the audio output by the acoustic transducer 110 is configured to substantially reduce the road noise perceived at the target location(s) 102, resulting in a feedback signal 120 with decreased magnitude.

As the ANC system 100 adapts to cancel road noise in the vehicle cabin, the filter coefficients 126 may converge to a set of values that substantially reduces the road noise at the target location(s) 102. Convergence of the filter coefficients 126 may indicate that an optimization algorithm of the adaptive filter has found a solution and that substantial noise cancellation of the road noise has been achieved. In other words, this converged state may be indicative of a "good" state, in which the ANC system 100 successfully performs noise cancellation at the target location(s) 102.

In order to detect a converged state of the filter coefficients 126, the ANC system 100 includes a convergence detector 250. For the purposes of explaining how the convergence detector 250 operates, a simplified scenario is presented first in which complete noise cancellation is desired. For example, this may include situations in which there are no desirable music or speech signals present in the vehicle cabin and complete silence is preferred. In this simplified scenario, we let $Y_{on}$ represent the signal at the target location 102 in the vehicle cabin 104 when the ANC system 100 is in an on-state (e.g., performing noise cancelling operations). Consequently, $$Y_{on}=Y_{fb} \quad \text{(Eqn. 1)}$$

because the feedback signal 120 detected by the feedback sensor 108 (or an array of feedback sensors) is precisely the signal (or estimate of the signal) at the target location 102 in an on-state of the ANC system 100. Since the objective in the present scenario is complete silence, any signal picked up by the feedback sensor 108 can also be considered an error signal E and is representative of a difference between the noise that would be heard in an off-state of the ANC system 100, $Y_{off}$, and the cancellation signal, $Y_{canc}$, generated by the ANC system 100 in its on-state. That is, $$Y_{fb}=Y_{off}-Y_{canc}=E \quad \text{(Eqn. 2),}$$

which after rearrangement, becomes $$Y_{off}=Y_{fb}+Y_{canc} \quad \text{(Eqn. 3).}$$

However, the precise cancellation signal, $Y_{canc}$, heard at the target location may be unobtainable because the physical pathway between the driver 110 and the feedback sensor 108 is unknown. Hence, we estimate the cancellation signal at the target location (e.g., the user's ear), $\hat{Y}_{canc}$ (132), by combining an estimate of the transfer function from the driver 110 to the feedback sensor 108, $\hat{T}_{de}$ (130), with the driver signal 118 as follows $$\hat{Y}_{canc}=\hat{T}_{de}W_{adapt}A \quad \text{(Eqn. 4).}$$

Using this estimate of the cancellation signal, the sound heard in an off-state of the ANC system 100, $\hat{Y}_{off}$, can then be estimated by $$\hat{Y}_{off}=Y_{fb}+\hat{Y}_{canc} \quad \text{(Eqn. 5).}$$

Taking the power spectral density of both sides of Eqn. 5 gives the following result:

$$S_{\hat{Y}_{off}\hat{Y}_{off}}=S_{Y_{fb}Y_{fb}}+S_{\hat{Y}_{canc}\hat{Y}_{canc}}+S_{Y_{fb}\hat{Y}_{canc}}+S_{\hat{Y}_{canc}Y_{fb}} \quad \text{(Eqn. 6).}$$

However, when the filter coefficients 126 have converged and substantial noise cancellation has been achieved, $$S_{Y_{fb}\hat{Y}_{canc}}+S_{\hat{Y}_{canc}Y_{fb}}\rightarrow 0 \quad \text{(Eqn. 7),}$$

because $Y_{fb}$ (120) becomes orthogonal to $\hat{Y}_{canc}$ (132). Consequently, as the filter coefficients 126 converge, $$S_{\hat{Y}_{off}\hat{Y}_{off}}\rightarrow S_{Y_{fb}Y_{fb}}+S_{\hat{Y}_{canc}\hat{Y}_{canc}} \quad \text{(Eqn. 8),}$$

and after rearrangement, $$\frac{S_{\hat{Y}_{off}\hat{Y}_{off}}}{S_{Y_{fb}Y_{fb}}+S_{\hat{Y}_{canc}\hat{Y}_{canc}}}\rightarrow 1. \quad \text{(Eqn. 9)}$$

Therefore, the value of the ratio $$\frac{S_{\hat{Y}_{off}\hat{Y}_{off}}}{S_{Y_{fb}Y_{fb}}+S_{\hat{Y}_{canc}\hat{Y}_{canc}}}$$

(referred to herein as a "convergence metric") can be used as an indicator for convergence because it asymptotically approaches a value of 1 as the ANC system 100 approaches a converged state. Taking $Y_{fb}$ (120) and $\hat{Y}_{canc}$ (132) as input, the convergence detector 250 can perform the above calculations to compute the convergence metric and determine whether a converged state has been achieved. In some implementations, the convergence detector may be included within a control system implemented by a controller (e.g., controller 112). Compared to monitoring the values of the adaptive filter coefficients 126 themselves, using the convergence metric presented here may provide the advantage of robust performance even in scenarios where the coefficients 126 adapt very slowly or at different rates.

In some cases, determining that a converged state has been achieved can involve comparing the convergence metric to one or more threshold values. In some cases, a single threshold value can be used, such as a percent variation around 1. The percent variation threshold may be set to a value between 0% and 20%, (e.g., 1%, 5%, 10%, 15%, etc.). For example, if the percent variation threshold is set to 10%, the convergence detector 250 would indicate that the adaptive filter coefficients 126 have converged if the convergence metric falls between 0.9 and 1.1. On the other hand, if the convergence metric has a percent variation from 1 greater than the 10% threshold, the convergence detector 250 would indicate that the coefficients 126 have not converged. In some cases, two threshold values can be used to establish a range for the convergence metric within which the convergence detector 250 would indicate that the coefficients 126 have converged. The range may or may not be symmetrically centered at a value of 1. For example, the convergence detector 250 may indicate that the coefficients 126 have converged if and only if the convergence metric is greater than a first threshold value of 0.85, and less than a second threshold value of 1.1. Other threshold conditions can be used in various implementations.

In some cases, a single convergence metric can be calculated across all frequencies prior to being compared to the one or more threshold values by the convergence detector 250. In some cases, multiple convergence metrics can be calculated, each corresponding to the coefficients of a particular frequency subband or bin. In cases where multiple convergence metrics are calculated, the convergence detector 250 can implement various rules for indicating that a converged state has been achieved. For example, the convergence detector 250 may only consider the convergence metric of a specific frequency bin (e.g., a frequency range corresponding to a high energy bin, a frequency bin within the frequency range corresponding to road noise, etc.) in order to determine if a converged state has or has not been achieved. Alternatively, the convergence detector 250 may consider the convergence metrics of multiple frequency bins (e.g., as may cover a frequency range corresponding to road noise). For example, the convergence detector 250 may determine that the convergence metric of every frequency bin individually satisfies one or more threshold conditions prior to indicating that a converged state has been achieved. In some cases, the one or more threshold conditions may be frequency dependent. In this way, the convergence detector 250 can account for variations in the convergence rate of different frequency bins due to, for example, differences in the energy content of the frequency bins. In some examples, the convergence detector 250 may determine that an average of the convergence metric of multiple frequency bins satisfies a threshold condition. Various other rules for detecting convergence can be used in addition to or instead of those described here.

While the convergence metric described above approaches a value of 1 as the adaptive filter coefficients 126 converge, alternative convergence metrics may be implemented. For example, the convergence metric may be scaled by multiplication, shifted by a constant, combined with other terms, etc. to generate an alternative convergence metric that approaches a value other than 1 as the coefficients 126 converge while maintaining the described relationship between $\hat{Y}_{off}$, $Y_{fb}$, and $\hat{Y}_{canc}$.

In some implementations, the convergence detector 250 may use the convergence metric in combination with one or more other metrics to determine whether a converged state has been achieved. For instance, in some cases the initial adaptive filter coefficients 126 may be set to zero or close to zero (e.g., when the ANC system 100 is reset and the coefficients are reverted to an initialization state). In some cases, the initial adaptive filter coefficients 126 may be very small relative to the target coefficients, such as when the initial coefficients correspond to a smooth road condition and the target coefficients correspond to a rough road condition. In these and other scenarios where the initial coefficients 126 are equal to zero or very small compared to the target solution, the convergence metric may yield a value of 1 (or close to 1) because $Y_{fb}$ is approximately orthogonal to $\hat{Y}_{canc}$ and $\hat{Y}_{canc}\approx 0$ (which implies that $S_{\hat{Y}_{canc},\hat{Y}_{on}} = S_{\hat{Y}_{canc},E}\approx 0$). As a result, the convergence metric may incorrectly indicate that convergence has been achieved.

Accordingly, in some implementations, one or more additional metrics may be used in combination with the convergence metric to resolve false convergence detections. For example, in some cases the convergence detector 250 may determine a ratio of the on- and off-state signals as follows:

$$\frac{\hat{Y}_{off}}{Y_{on}} \text{ or } \frac{\hat{Y}_{off}}{E}. \quad \text{(Eqn. 10)}$$

Initially, the ratio described in Eqn. 10 is equal to 1 (or close to 1) because the estimate of the noise signal and the error signal are equal (or close to equal). However, as the ANC system 100 adapts, the error signal begins to decrease relative to the noise signal if the system is operating correctly and canceling noise. Thus, by comparing the ratio with one or more threshold values, the convergence detector 250 can determine whether the error signal has decreased and noise cancelation is occurring. For example, the convergence detector 250 may determine whether the ratio exceeds a threshold having a value that is some percentage greater than 1 (e.g., 1%, 5%, 10%, 15%, 20%, 25%, 30%, etc.). If both the ratio and the convergence metric described above indicate convergence (e.g., by satisfying the respective threshold conditions) at the same time or within a predefined period of time, the convergence detector 250 can determine that a converged state has been achieved.

In some cases, a single ratio can be calculated across all frequencies before being compared to the one or more threshold values by the convergence detector 250. In some cases, multiple ratios can be calculated, each corresponding to the coefficients of a particular frequency subband or bin. In cases where multiple ratios are calculated, the convergence detector 250 can implement various rules for determining whether a converged state has been achieved. For example, the convergence detector 250 may only consider the ratio calculated for a specific frequency bin (e.g., a frequency range corresponding to road noise) for determining whether a converged state has been achieved. Alternatively, the convergence detector 250 may consider the ratios calculated for multiple frequency bins by, for example, determining whether the ratio calculated for each frequency bin individually satisfies one or more threshold conditions (which may be frequency dependent), or determining whether an average of the ratios of multiple frequency bins satisfies a threshold condition. Various other rules for detecting convergence can be used in addition to or instead of those described here. Further, although the ratio is described as being used in combination with the convergence metric, in some cases the ratio may be used instead of the convergence metric or in combination with another metric to determine whether a converged state has been achieved.

In some implementations, responsive to detecting a converged state of the adaptive filter coefficients 126, the ANC system 100 may store the coefficient values to a storage device, such as memory or another computer-readable storage medium. In some cases, data (e.g., speed, acceleration, time, location, etc.) from a variety of sensors, such as the reference sensor(s) 106 and the feedback sensor(s) 108, among others, may also be stored in response to detecting a converged state. The stored coefficient values and/or sensor data may be used in various scenarios to improve performance of the ANC system 100. For example, if a converged state has been achieved and detected prior to turning off a vehicle, the values of the coefficients 126 can be stored and used as an initial condition upon starting up the vehicle at a future time. In another example, if a converged state is achieved and detected at a certain location and speed, the values of the coefficients can be stored and used at a later time if the vehicle detects a similar scenario (e.g., during a daily morning commute). In yet another example, if the ANC system 100 goes unstable (e.g., the adaptive filter coefficients 126 begin to diverge), the ANC system 100 may reset the coefficient values by loading stored coefficient values from a prior converged or initialization state in order to restore stability. The technology described may have various advantages including improving the noise cancellation performance of the ANC system 100, reducing the time and/or processing requirements to perform noise cancellation, and quickly resolving instabilities that may affect the ANC system 100.

Figure 3:
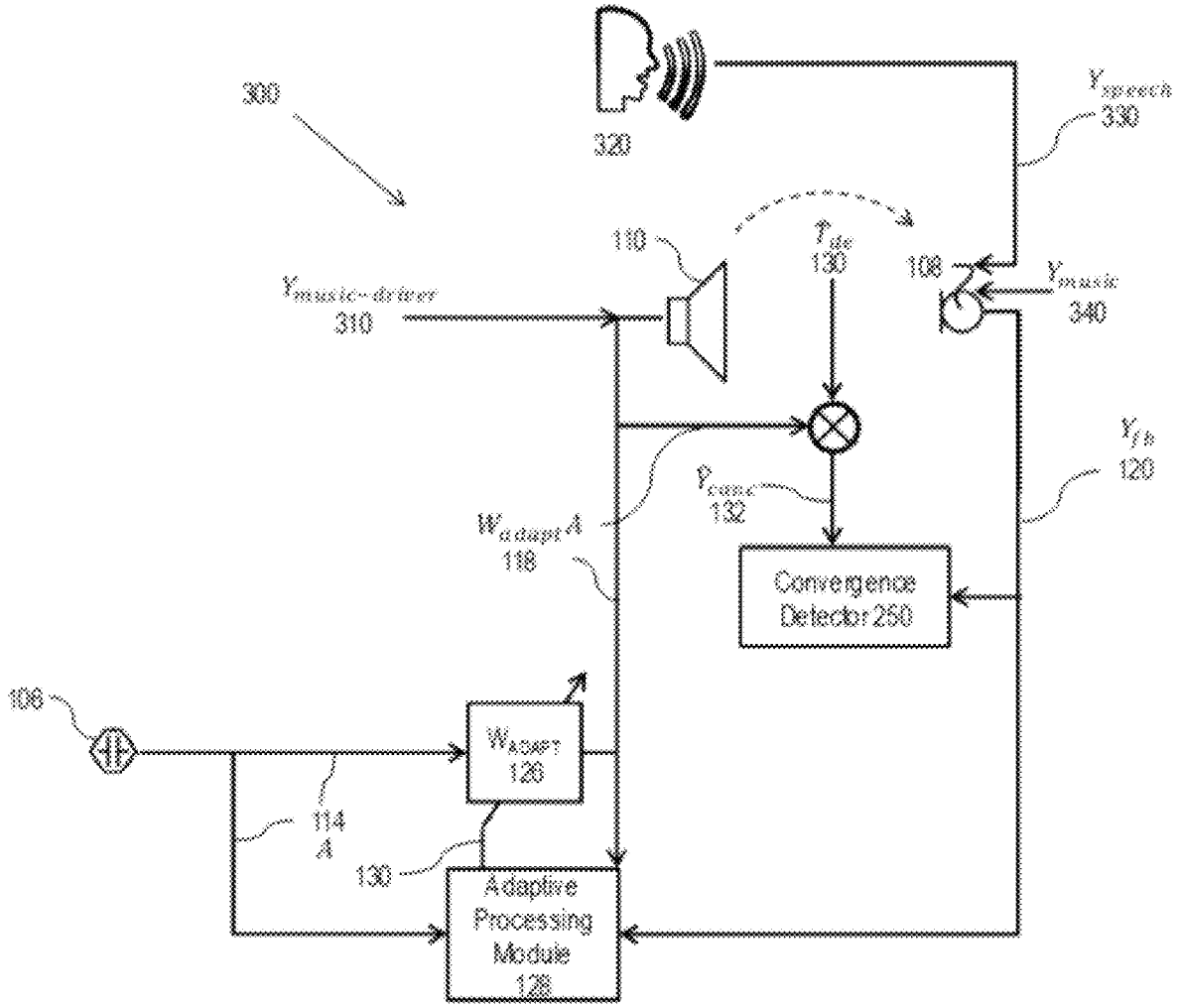
FIG. 3 is a diagram of an example SISO ANC system in the presence of a music signal and a speech signal.

Although FIG. 2 focuses on a simplified scenario where complete noise cancellation is desired, the technology described can be generalized to other use cases. Referring now to FIG. 3, a single-input single-output (SISO) ANC system 300 is shown in which a music signal, a speech signal, and/or some other desired signal is present. For example, in the vehicle setting, a user may wish to reduce the perceived level of road noise without affecting his or her ability to hear music, the voice of another person in the vehicle, an alarm signal, etc. The ANC system 300 has many similarities to the ANC system 100, with analogous parts being labeled with the same reference numbers. However, compared to the ANC system 100, the ANC system 300 includes additional audio sources. First, the driver 110 receives a music signal, $Y_{music\text{-}driver}$ (310), in addition to the driver signal 118. In other words, in the ANC system 300, the driver 110 is configured not only to generate audio configured to cancel road noise at the target location, but also to generate audio intended to be heard at the target location. Second, the feedback sensor 108 (e.g., microphone) of the ANC system 300 is configured to pick up a speech signal, $Y_{speech}$ (330), originating from a person 320 within the vehicle cabin, and a music signal, $Y_{music}$ (340), being played by the driver 110, each of which may be intended to be heard at the target location.

Similar to the ANC system 100, in the ANC system 300, $$Y_{on}=Y_{fb} \quad \text{(Eqn. 11)}$$

because the feedback signal 120 picked up by the feedback sensor 108 is precisely the signal (or estimate of the signal) at the target location 102 in an on-state of the ANC system 300. However, in this scenario, the feedback signal 120 includes not only the road noise-related error signal, $E_{road}$, but also the desired music signal 340 and desired speech signal 330. That is, $$Y_{fb}=(Y_{off,road}-Y_{canc,road})+Y_{music}+Y_{speech}=E_{road}+Y_{music}+Y_{speech} \quad \text{(Eqn. 12)}$$

After including the music signal 340 and speech signal 330 within the feedback signal 120, the mathematics follow Eqns. 2-9. This results in the same convergence metric, $$\frac{S_{\hat{Y}_{off}\hat{Y}_{off}}}{S_{Y_{fb}Y_{fb}}+S_{\hat{Y}_{canc}\hat{Y}_{canc}}},$$

which approaches a value of 1 as the values of the adaptive filter coefficients 126 converge. This is due to the orthongonality between the music or speech content and the cancellation signal, which is proportional to road noise, over the time scales of adaptation. In some implementations, the ANC system 300 may use the convergence metric in combination with one or more other metrics, such as the ratio described above in Eqn. 10, to determine whether a converged state has been achieved. Therefore, the ANC system 300 is able to perform analogous convergence detection to the ANC system 100, even in scenarios where desired music, speech, and other sound signals are present within the vehicle cabin.

Figure 4:
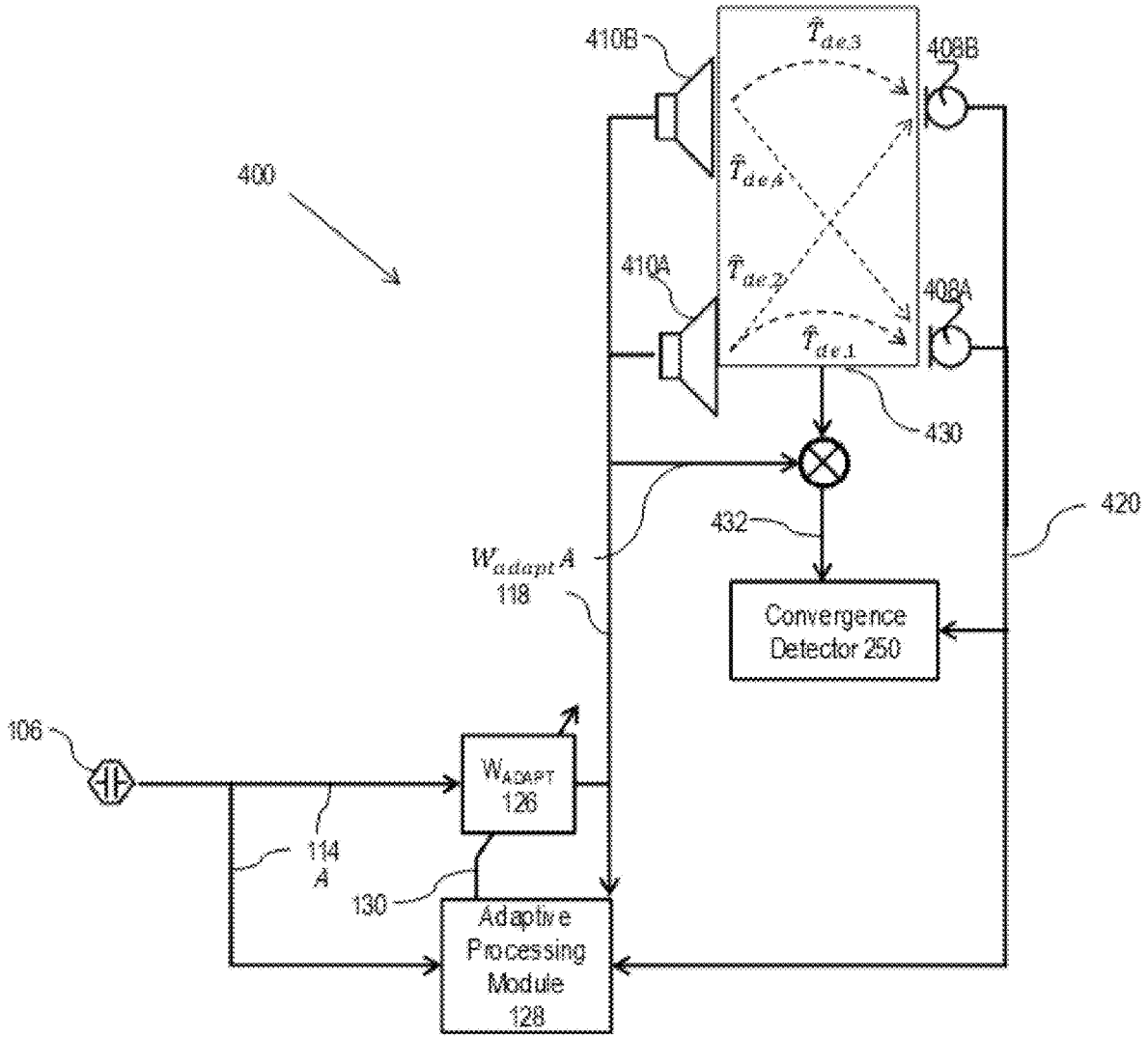
FIG. 4 is a diagram of a multiple-input multiple-output (MIMO) ANC system.

Although the ANC systems 100, 300 are shown as a single-input single-output (SISO) ANC systems with one acoustic transducer 110 and one feedback sensor 108, other system architectures may be implemented. Referring now to FIG. 4, an ANC system 400 is shown having a multiple-input multiple-output (MIMO) architecture. Compared to the SISO ANC system 100, the ANC system 400 includes multiple acoustic transducers and multiple feedback sensors. In particular, for demonstration purposes, we focus on the MIMO case having two acoustic transducers 410A, 410B and two feedback sensors 408A, 408B (e.g., microphones), although in other cases, additional drivers and/or feedback sensors may be included. Further, although the ANC system 400 has a single reference sensor 106, additional reference sensors may be included in some implementations.

Due to the presence of multiple drivers and multiple feedback sensors, the ANC system 400 has multiple driver-to-ear physical pathways that may be estimated. For example, in FIG. 4, $\hat{T}_{de,1}$ is the estimate of the transfer function from the first driver 410A to the first feedback sensor 408A. $\hat{T}_{de,2}$ is the estimate of the transfer function from the first driver 410A to the second feedback sensor 408B. $\hat{T}_{de,3}$ is the estimate of the transfer function from the second driver 410B to the second feedback sensor 408B. $\hat{T}_{de,4}$ is the estimate of the transfer function from the second driver 4108 to the first feedback sensor 408A.

For each feedback sensor 408A, 408B, the mathematics follow Eqns. 1-3, as described for the ANC system 100. However, rather than estimating a single cancellation signal, the ANC system 400 may estimate a cancellation signal at the target location based on the signals received from each feedback sensor 408A, 408B corresponding to both the first driver 410A and the second driver 410B. These individual cancellation signals can in turn be summed to produce a total cancellation signal at the target location. Specifically, for the first feedback sensor 408A, the total cancellation signal at the target location can be expressed as $$\hat{Y}_{total_canc}=\hat{T}_{de,1}W_{adapt,1}A+\hat{T}_{de,4}W_{adapt,4}A. \quad \text{(Eqn. 13),}$$

and for the second feedback sensor 408B, the total cancellation signal at the target location can be expressed as $$\hat{Y}_{total_canc}=\hat{T}_{de,2}W_{adapt,2}A+\hat{T}_{de,3}W_{adapt,3}A. \quad \text{(Eqn. 14),}$$

where $W_{adapt,i}$ represents the adaptive filter matrix from the reference signals A to the driver i. For each feedback sensor 408A, 408B, the mathematics follows Eqns. 5-9, where the single cancellation signal, $\hat{Y}_{canc}$, is replaced with the total cancellation signal $\hat{Y}_{total_canc}$. As a result, a convergence metric, $$\frac{S_{\hat{Y}_{off}\hat{Y}_{off}}}{S_{Y_{fb}Y_{fb}}+S_{\hat{Y}_{total_canc}\hat{Y}_{total_canc}}},$$

can be calculated for the target location using the signals received from each feedback sensor 408A, 408B, with each convergence metric approaching a value of 1 as the adaptive filter coefficients 126 converge.

In some cases, the convergence detector 250 can determine that a converged state has been achieved when the convergence metric for the target location determined for each feedback sensor 408A, 408B satisfies one or more threshold conditions, such as the threshold conditions described in relation to FIG. 2. In some cases, the convergence metrics for the target location determined for each feedback sensor 408A, 408B can be averaged to determine an aggregate convergence metric, $$<\frac{S_{\hat{Y}_{off}\hat{Y}_{off}}}{S_{Y_{fb}Y_{fb_{earmics}}}+S_{\hat{Y}_{total_{canc}}\hat{Y}_{total_{canc}}}}>_{earmics},$$

where the "earmics" subscript represents the signals at the target microphones or locations. The aggregate convergence metric may then be compared by the convergence detector 250 to one or more threshold values in order to determine if a converged state has been achieved. In some cases, the individual PSDs can themselves be averaged across feedback sensors to calculate an alternative aggregate convergence metric, $$\frac{<S_{\hat{Y}_{off}\hat{Y}_{off}}>_{earmics}}{<S_{Y_{fb}Y_{fb}}>_{earmics}+<S_{\hat{Y}_{canc}\hat{Y}_{canc}}>_{earmics}},$$

which can also be compared to one or more threshold values to determine if a converged state has been achieved. In some implementations, the individual or aggregate convergence metrics may be combined with one or more other metrics, such as the ratio described in Eqn. 10, to determine whether convergence has been achieved. The ratio may be determined based on the signals received from some or all of feedback sensors 408A, 408B, and may be compared to one or more thresholds on an individual or aggregate basis. Various combinations of convergence metrics for the target location using the multiple feedback sensors 408A, 408B can be implemented.

Figure 5:
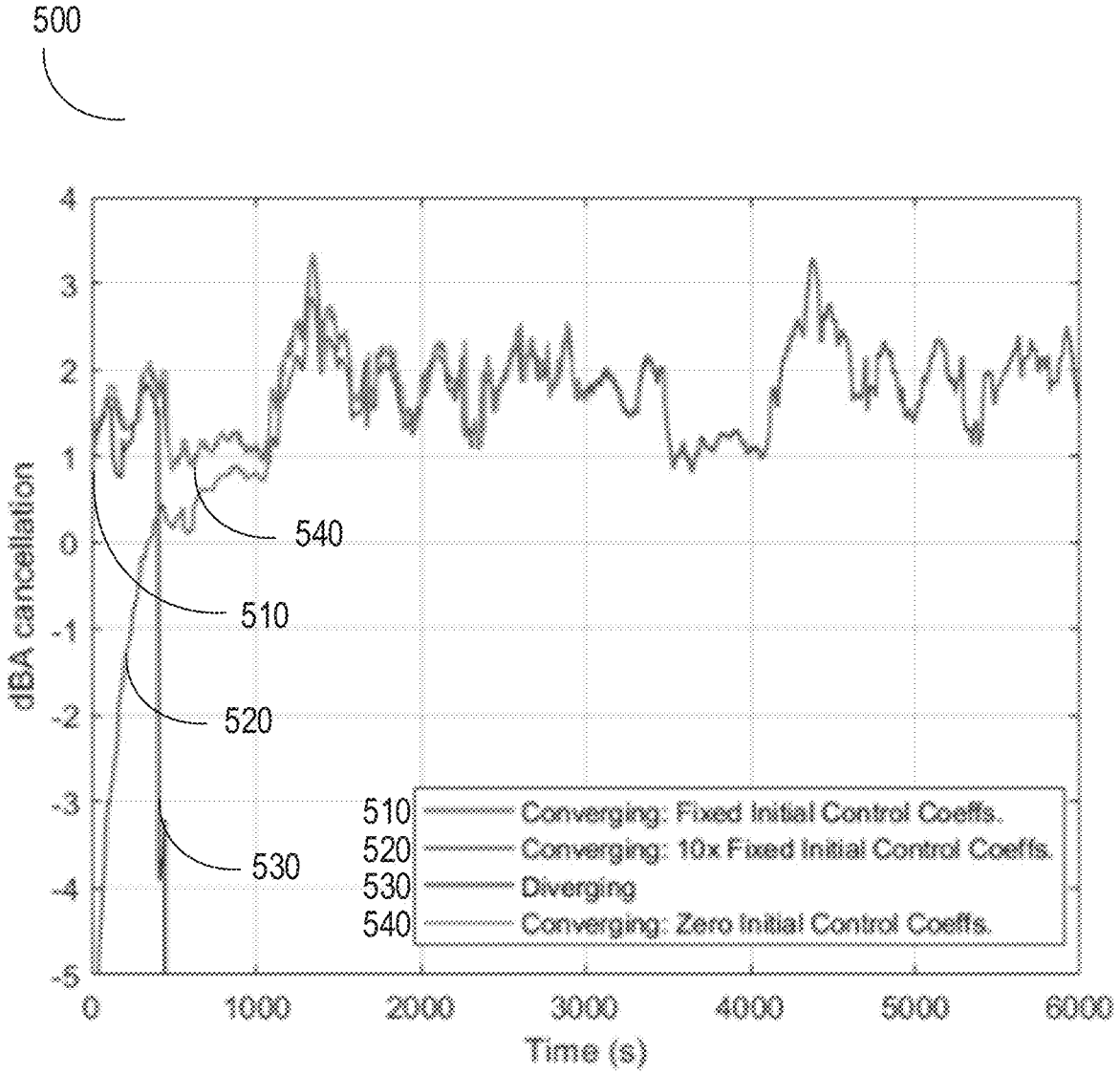
FIG. 5 is a graph of the time-evolution of an average noise cancellation across multiple microphones in various scenarios.

FIG. 5 is a graph 500 showing the time-evolution of an average noise cancellation across multiple feedback sensors of an example ANC system in various scenarios. In a test setting, average noise cancellation of an ANC system can be measured by comparing the acoustic signal captured or estimated at one or more target locations while playing a noise signal in both an on- and off-state of the ANC system. In a first scenario 510, the ANC system is loaded with an initial set of adaptive filter coefficients, and average noise cancellation is measured over time as the system converges. In a second scenario 540, the ANC system is loaded with an initial set of adaptive filter coefficients obtained by scaling the coefficients in the first scenario 510 by a factor of ten, again measuring average noise cancellation over time as the system converges. In a third scenario 520, the ANC system is loaded with all of its adaptive filter coefficients initially set to zero, and average noise cancellation is measured over time as the system converges. Finally, in a fourth scenario 530, the coefficients of the ANC system never converge, but rather diverge, and the corresponding average noise cancellation is measured over time.

As observed in the graph 500, for every scenario in which the ANC system converges (e.g. scenarios 510, 520, 540), the average noise cancellation eventually becomes very similar (e.g., after 2500 seconds). This suggests that the coefficients of the ANC system all converge to a similar solution in each scenario. In contrast, in the diverging scenario 530, the adaptive filter coefficients never converge to a solution, and average noise cancellation drops off very quickly. This evidence suggests that convergence can indeed be an indicator of a "good state" in which satisfactory levels of noise cancellation are being achieved by the ANC system.

Even among the converging scenarios 510, 520, 540, it is observed that greater noise cancellation is achieved earlier in some scenarios than in others. For example, in the first 1500 seconds, graph 500 shows that scenarios 510, 540 provide much greater noise cancellation than scenario 530. This highlights the role of the initial values of the adaptive filter coefficients for determining the speed at which a noise cancelling solution is found. Consequently, graph 500 motivates loading the adaptive filter coefficients with values from a previously found converged state for the purpose of achieving faster convergence and greater noise cancellation by the ANC system.

Figure 6:
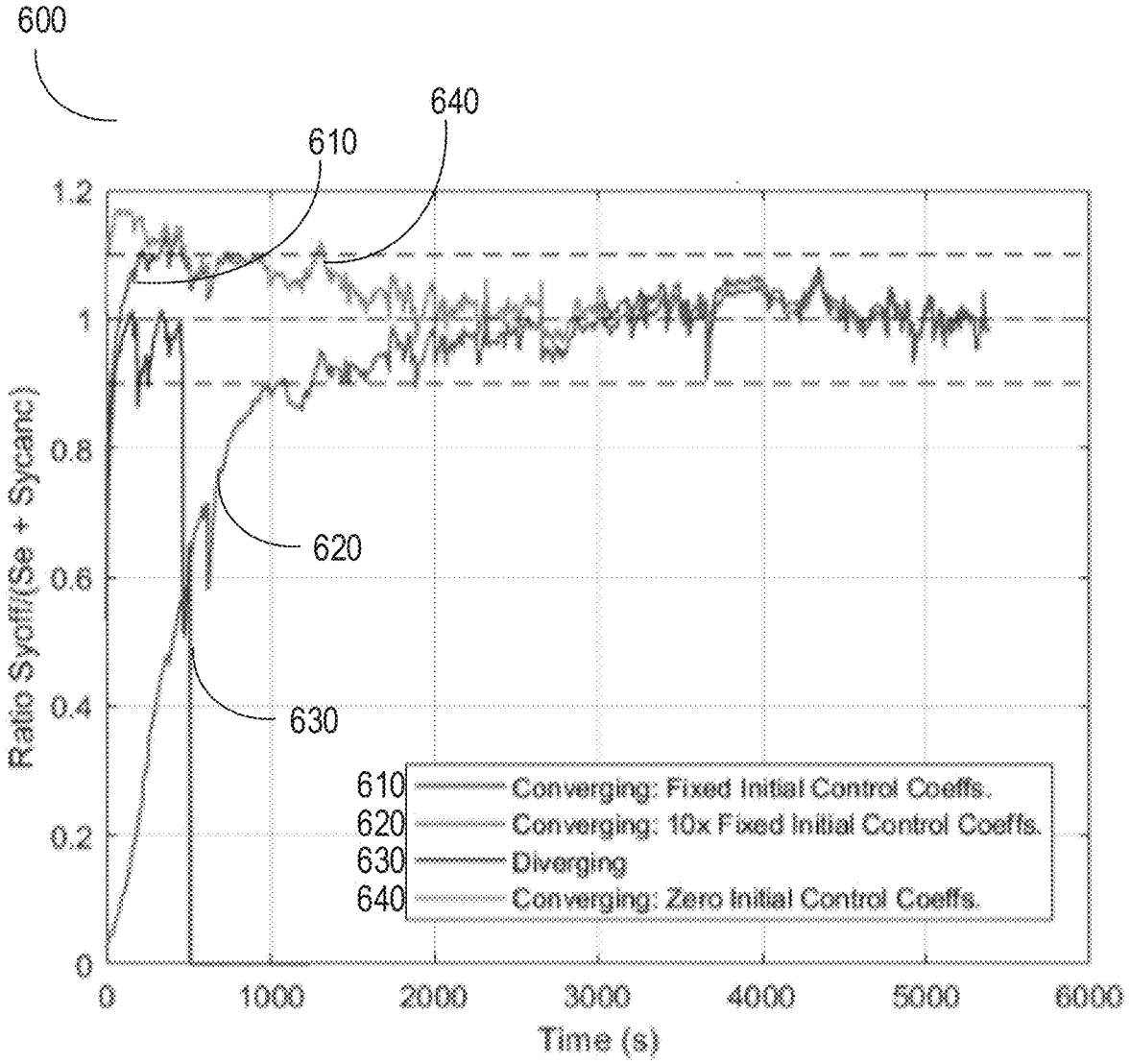
FIG. 6 is a graph of the time-evolution of a convergence metric in the various scenarios of FIG. 5.

Although FIG. 5 shows how an absolute measure of noise cancellation can be used to detect convergence, in some cases, such a measurement cannot be obtained. For example, in a vehicle setting where an ANC system is always on, simultaneous measurements of acoustic signals in an off-state of the ANC system may not be directly accessible. However, as described above, the acoustic signals in an off-state of the ANC system can be estimated, and convergence can be detected based on a convergence metric. FIG. 6 is a graph 600 showing the time-evolution of the convergence metric presented in Eqn. 9, computed for an ANC system operating in various scenarios. Analogous to FIG. 5, in a first scenario 610, the ANC system is loaded with an initial set of adaptive filter coefficients, and the convergence metric is measured over time as the system converges. In a second scenario 640, the ANC system is loaded with an initial set of adaptive filter coefficients obtained by scaling the coefficients in the first scenario 610 by a factor of ten, again measuring the convergence metric over time as the system converges. In a third scenario 620, the ANC system is loaded with all of its adaptive filter coefficients initially set to zero, and the convergence metric is measured over time as the system converges. Finally, in a fourth scenario 630, the coefficients of the ANC system diverge over time, and the corresponding convergence metric is measured.

As described above, ideal convergence would correspond to the convergence metric approaching a value of 1, and in this implementation, a 10% variation around 1 is used as a threshold to determine if a converged state has been achieved. In other words, a convergence detector (e.g., convergence detector 250) of an ANC system (e.g., ANC system 100, 300, 400, 800) would indicate that a converged state has been achieved if the convergence metric falls within a range of 0.9-1.1. As observed in graph 600, the convergence metric is successfully able to identify converged states, with all of the converging scenarios (e.g., scenarios 610, 620, 640) eventually falling within the target range. On the other hand, the diverging scenario 630 fails to stay within the target range after approximately 500 seconds. Moreover, similar to the noise cancellation measured in FIG. 5, the convergence metric reveals that the ANC system reaches a converged state in scenario 620 much later than it does in scenarios 610, 640. This suggests that the convergence metric presented here provides a viable alternative for convergence detection in settings where direct measurements of noise cancellation may not be feasible.

Figure 7:
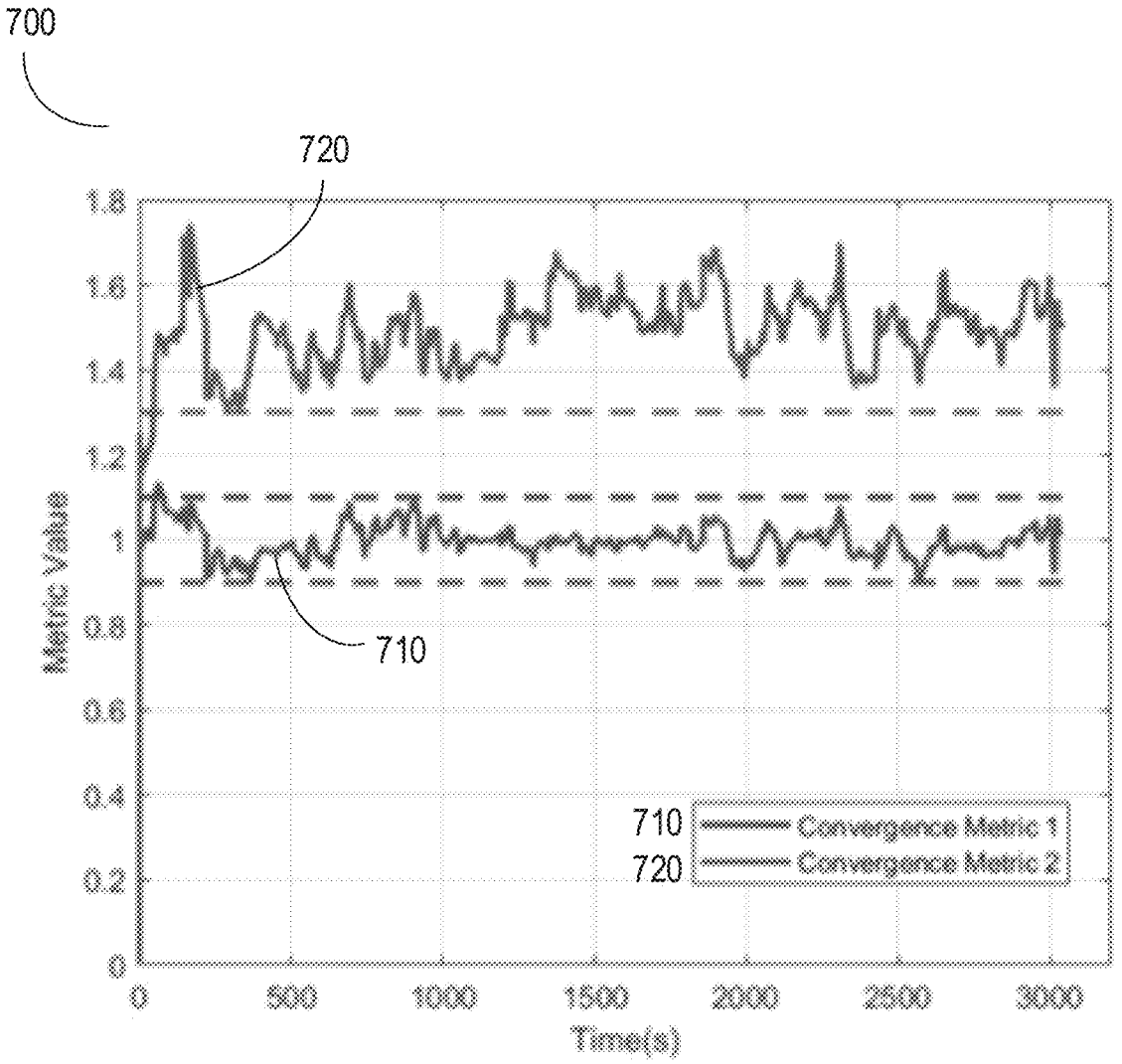
FIG. 7 is a graph of the time-evolution of two convergence metrics.

FIG. 7 is a graph 700 showing the time-evolution of two convergence metrics 710, 720. The convergence metric 710 may correspond to the convergence metric described in Eqn. 9. The convergence metric 720 may correspond to the convergence metric, or ratio, described in Eqn. 10.

As described above, in some examples, a convergence detector (e.g., convergence detector 250) of the ANC system (e.g., ANC system 100, 300, 400, 800) may use both the convergence metrics 710, 720 to determine whether a converged state has been achieved. For example, the convergence detector may compare the value of the convergence metric 710 to one or more threshold values to determine whether the metric indicates convergence. In the scenario shown in graph 700, the convergence detector may determine that the convergence metric 710 indicates convergence when its value falls within a range of 0.9 and 1.1, although other threshold values may be used in various implementations. Similarly, the convergence detector may compare the value of the convergence metric 720 to one or more threshold values (which may be different than the one or more threshold values applied to the convergence metric 710) to determine whether the metric indicates convergence. For instance, the convergence detector may determine that the convergence metric 720 indicates convergence when its value exceeds 1.3. When both of the convergence metrics 710, 720 satisfy their respective threshold(s) (either simultaneously or within a predefined time period), the convergence detector may determine that a converged state has been achieved.

By using both of the convergence metrics 710, 720 to determine convergence, the convergence detector may reduce false convergence detections that may occur, for example, when the initial filter coefficients 126 are equal to zero or very small compared to the target solution. For instance, graph 700 shows that the convergence metric 710 is initially within the threshold range at time 0, but falls outside the range shortly thereafter before ultimately maintaining a value within the range. On the other hand, the convergence metric 720 is initially below the threshold value in graph 700 before reaching a value that exceeds the threshold. If only the convergence metric 710 were used to determine convergence in the scenario shown in graph 700, a false convergence may be detected at time 0 before the ANC system has time to adapt and achieve a true converged state. However, by using both of the convergence metrics 710, 720 to determine convergence, the false convergence detection may be avoided.

ANC systems may combine the techniques described here with a variety of other techniques for further performance enhancement. For example, in some cases, an ANC system may supplement the convergence detection described above with divergence detection. Example ANC systems with divergence detecting systems and techniques are described in U.S. patent application Ser. No. 16/369,620 filed on Mar. 29, 2019, which is incorporated herein by reference in its entirety.

Figure 8:
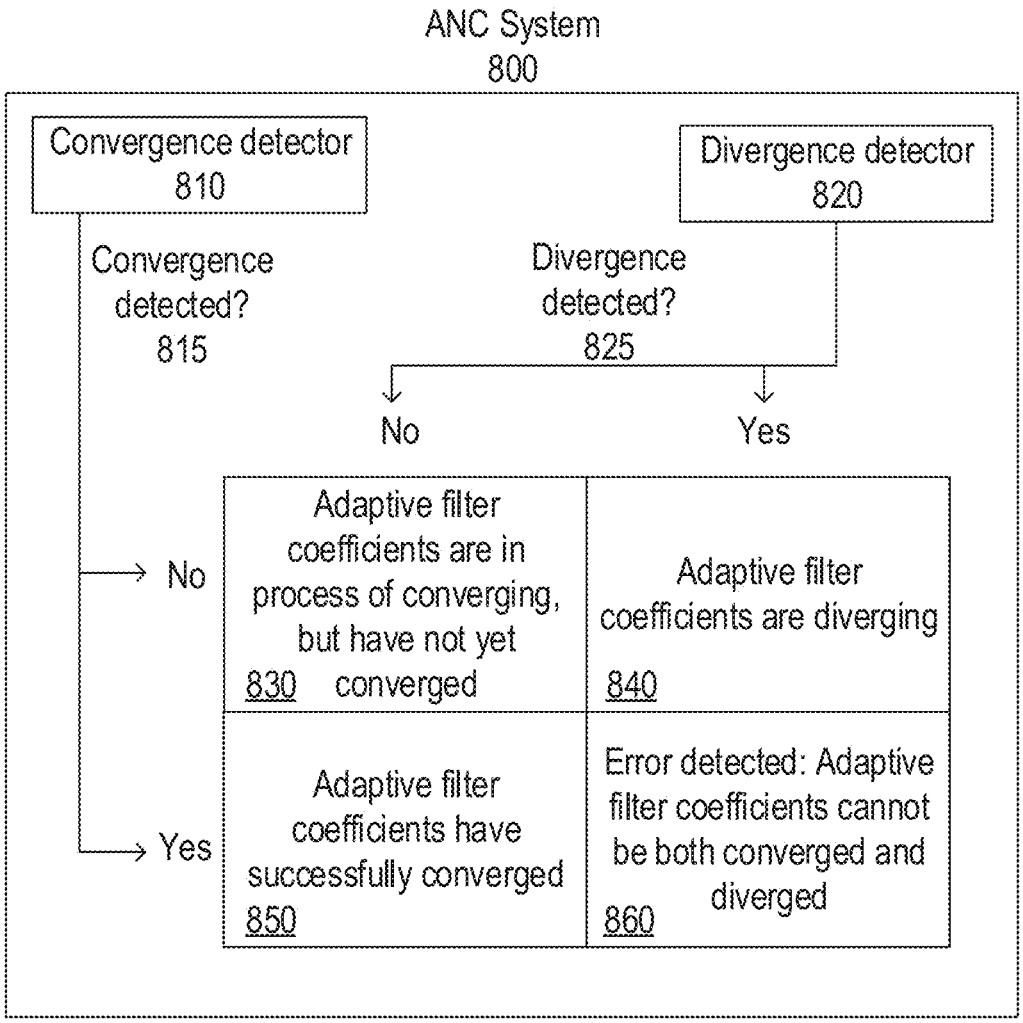
FIG. 8 is a diagram of an ANC system that includes both convergence detection and divergence detection.

FIG. 8 shows a diagram of an example ANC system 800 including both a convergence detector 810 and a divergence detector 820. The convergence detector 810 provides a binary indication of whether or not convergence has been detected (815) while the divergence detector 820 provides a binary indication of whether or not divergence has been detected (825). In some cases, the convergence detector 810 and the divergence detector 820 may share one or more components (e.g., processors), while in some cases, they may be completely separate.

The combination of convergence detection and divergence detection in a single ANC system may have the advantage of reducing false positive rates and providing more detailed information about the current state of the ANC system 800. For example, in one scenario 850, if convergence is detected while divergence is not detected, the ANC system 800 may determine that its adaptive filter coefficients have successfully achieved a converged state. In another scenario 840, if convergence is not detected while divergence is detected, the ANC system 800 may determine that the adaptive filter coefficients are diverging. The ANC system may then take appropriate actions in response to mitigate the instability (e.g., loading a set of coefficient values from a previously obtained converged state). In yet another scenario 830, if neither convergence nor divergence is detected, the ANC system may determine that its adaptive filter coefficients are in the process of converging, but have not yet achieved a converged state. Finally, in a fourth scenario 860, if both convergence and divergence are detected, the ANC system 800 may determine that an error has occurred since its adaptive filter coefficients cannot simultaneously be both converged and diverged.

Figure 9:
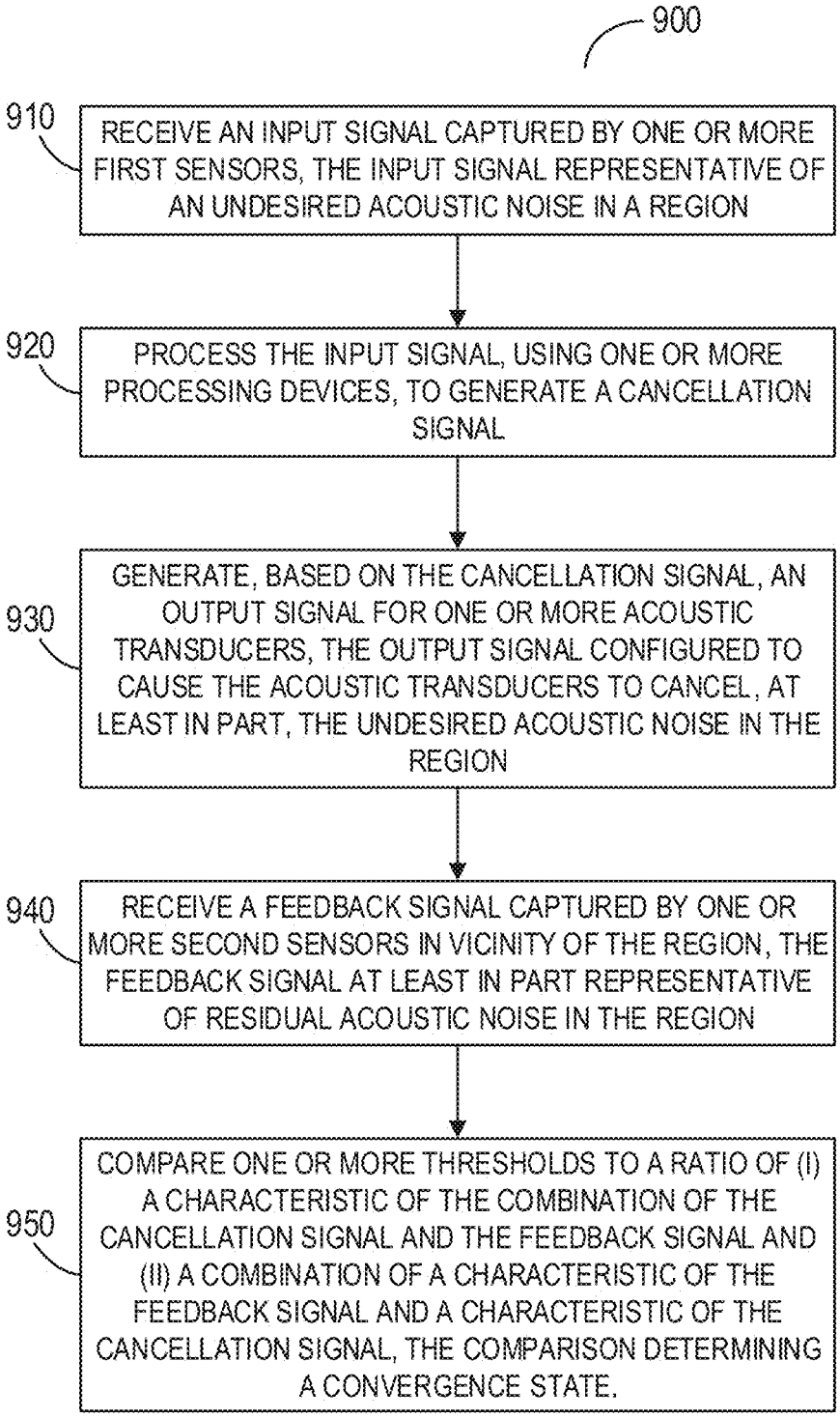
FIG. 9 is a flow chart of a process for determining that an ANC system has achieved a converged state.

FIG. 9 shows a flow chart of a process 900 for determining that an ANC system has achieved a converged state. In some implementations, the operations of the process 900 can be performed by one or more of the systems described above with respect to FIGS. 2-4 and 8 such as the ANC systems 100, 300, 400, and 800.

Operations of the process 900 include receiving, at one or more processing devices, an input signal captured by one or more first sensors (910). The input signal may be representative, at least in part, of an undesired acoustic noise in a region, such as the cancellation zone(s) 102. In some implementations, the one or more first sensors may be accelerometers. In some implementations, the one or more first sensors may be disposed at a vehicle, such as outside a cabin of the vehicle.

Operations of the process 900 further include processing the input signal, using the one or more processing devices, to generate a cancellation signal (920). In some implementations, an adaptive filter may be applied to the input signal to generate the cancellation signal. In some implementations, generating the cancellation signal may include estimating a transfer function from one or more acoustic transducers to a user's ear.

Operations of the process 900 further include generating, based on the cancellation signal, an output signal for one or more acoustic transducers (930). The output signal is configured to cause the acoustic transducers to cancel, at least in part, the undesired acoustic noise in the region.

Operations of the process 900 further include receiving, at the one or more processing devices, a feedback signal captured by one or more second sensors in vicinity of the region (940). In some implementations, the one or more second sensors may be disposed at a vehicle, such as inside a cabin of the vehicle. The feedback signal is, at least in part, representative of residual acoustic noise in the region. In some implementations, the feedback signal may include an audio component representative of music or speech.

Operations of the process 900 further include comparing, by the one or more processors, one or more thresholds to a ratio of (i) a characteristic of the combination of the cancellation signal and the feedback signal and (ii) a combination of a characteristic of the feedback signal and a characteristic of the cancellation signal, the comparison determining a convergence state (950). In some implementations, one or more of the characteristic of the combination of the cancellation signal and the feedback signal, the characteristic of the feedback signal, and the characteristic of the cancellation signal may be a power spectral density. In some implementations, one or more of the characteristic of the combination of the cancellation signal and the feedback signal, the characteristic of the feedback signal, and the characteristic of the cancellation signal may be an average power spectral density attained from the one or more second sensors. In some implementations, coefficients of the adaptive filter may be stored in response to determining the convergence state.

Figure 10:
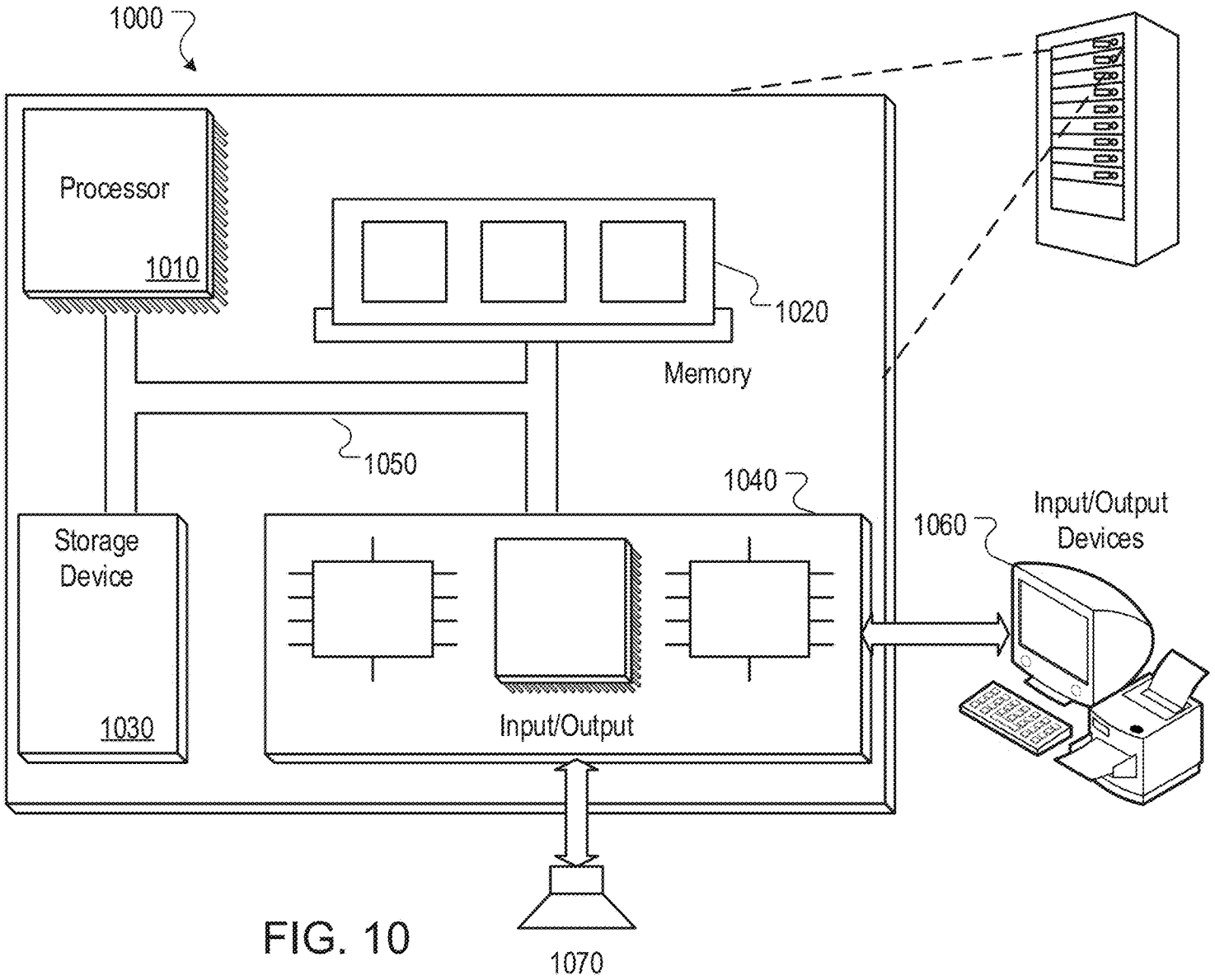
FIG. 10 is a block diagram of a computing device.

FIG. 10 is block diagram of an example computer system 1000 that can be used to perform operations described above. For example, any of the systems (e.g., 100, 300, 400, 800, etc.) or processes (e.g., 900), described above with reference to FIGS. 1-9, can be implemented using at least portions of the computer system 1000. The system 1000 includes a processor 1010, a memory 1020, a storage device 1030, and an input/output device 1040. Each of the components 1010, 1020, 1030, and 1040 can be interconnected, for example, using a system bus 1050. The processor 1010 is capable of processing instructions for execution within the system 1000. In one implementation, the processor 1010 is a single-threaded processor. In another implementation, the processor 1010 is a multi-threaded processor. The processor 1010 is capable of processing instructions stored in the memory 1020 or on the storage device 1030.

The memory 1020 stores information within the system 1000. In one implementation, the memory 1020 is a computer-readable medium. In one implementation, the memory 1020 is a volatile memory unit. In another implementation, the memory 1020 is a non-volatile memory unit.

The storage device 1030 is capable of providing mass storage for the system 1000. In one implementation, the storage device 1030 is a computer-readable medium. In various different implementations, the storage device 1030 can include, for example, a hard disk device, an optical disk device, a storage device that is shared over a network by multiple computing devices (e.g., a cloud storage device), or some other large capacity storage device.

The input/output device 1040 provides input/output operations for the system 1000. In one implementation, the input/output device 1040 can include one or more network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 1060, and acoustic transducers/speakers 1070.

Although an example processing system has been described in FIG. 10, implementations of the subject matter and the functional operations described in this can be specification implemented in other types of digital electronic circuitry, or in computer software, firmware, or hardware, including the structures disclosed in this specification and their structural equivalents, or in combinations of one or more of them.

This specification uses the term "configured" in connection with systems and computer program components. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus. The computer storage medium can be a machine-readable storage device, a machine-readable storage substrate, a random or serial access memory device, or a combination of one or more of them. Alternatively or in addition, the program instructions can be encoded on an artificially generated propagated signal, e.g., a machine-generated electrical, optical, or electromagnetic signal, which is generated to encode information for transmission to suitable receiver apparatus for execution by a data processing apparatus.

The term "data processing apparatus" refers to data processing hardware and encompasses all kinds of apparatus, devices, and machines for processing data, including by way of example a programmable processor, a computer, or multiple processors or computers. The apparatus can also be, or further include, special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, an app, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by special purpose logic circuitry, e.g., an FPGA or an ASIC, or by a combination of special purpose logic circuitry and one or more programmed computers. To provide for interaction with a user, embodiments of the subject matter described in this specification can be implemented on a computer having a display device, e.g., a light emitting diode (LED) or liquid crystal display (LCD) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser. Also, a computer can interact with a user by sending text messages or other forms of message to a personal device, e.g., a smartphone that is running a messaging application, and receiving responsive messages from the user in return.

Embodiments of the subject matter described in this specification can be implemented in a computing system that includes a back end component, e.g., as a data server, or that includes a middleware component, e.g., an application server, or that includes a front end component, e.g., a client computer having a graphical user interface, a web browser, or an app through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an HTML page, to a user device, e.g., for purposes of displaying data to and receiving user input from a user interacting with the device, which acts as a client. Data generated at the user device, e.g., a result of the user interaction, can be received at the server from the device.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A method comprising:

receiving an input signal captured by one or more first sensors, the input signal representative of an undesired acoustic noise in a region;

processing the input signal, using one or more processing devices, to generate a cancellation signal;

generating, based on the cancellation signal, an output signal for one or more acoustic transducers, the output signal configured to cause the acoustic transducers to cancel, at least in part, the undesired acoustic noise in the region;

receiving a feedback signal captured by one or more second sensors in vicinity of the region, the feedback signal at least in part representative of residual acoustic noise in the region;

determining a characteristic of the feedback signal;

determining a characteristic of the cancellation signal;

determining a characteristic of a combination of the cancellation signal and the feedback signal; and comparing one or more thresholds to a ratio of (i) the characteristic of the combination of the cancellation signal and the feedback signal and (ii) a combination of the characteristic of the feedback signal and the characteristic of the cancellation signal, the comparison determining a convergence state, wherein at least one of the characteristic of the combination of the cancellation signal and the feedback signal, the characteristic of the feedback signal, or the characteristic of the cancellation signal comprises a power spectral density.

2. The method of claim 1, further comprising:

applying an adaptive filter to the input signal to generate the cancellation signal.

3. The method of claim 2, further comprising:

responsive to determining the convergence state, storing coefficients of the adaptive filter.

4. The method of claim 1, wherein generating the cancellation signal comprises estimating a transfer function from the one or more acoustic transducers to a user's ear.

5. The method of claim 1, wherein the one or more first sensors comprise accelerometers.

6. The method of claim 1, wherein the one or more first sensors and the one or more second sensors are disposed at a vehicle.

7. The method of claim 1, wherein the feedback signal comprises an audio signal component representative of music or speech.

8. An active noise cancellation (ANC) system comprising:

one or more first sensors configured to generate an input signal, the input signal representative of an undesired acoustic noise in a region;

one or more acoustic transducers configured to generate output audio;

one or more second sensors configured to generate a feedback signal, the feedback signal at least in part representative of residual acoustic noise in the region; and a controller comprising one or more processing devices, the controller configured to:

process the input signal to generate a cancellation signal;

generate, based on the cancellation signal, an output signal for the one or more acoustic transducers, the output signal configured to cause the acoustic transducers to cancel, at least in part, the undesired acoustic noise in the region;

determine a characteristic of the feedback signal;

determine a characteristic of the cancellation signal;

determine a characteristic of a combination of the cancellation signal and the feedback signal; and compare one or more thresholds to a ratio of (i) the characteristic of the combination of the cancellation signal and the feedback signal and (ii) a combination of the characteristic of the feedback signal and the characteristic of the cancellation signal, the comparison determining a convergence state of the ANC system, wherein at least one of the characteristic of the combination of the cancellation signal and the feedback signal, the characteristic of the feedback signal, or the characteristic of the cancellation signal comprises a power spectral density.

9. The system of claim 8, further comprising an adaptive filter, wherein generating the cancellation signal comprises applying the adaptive filter to the input signal.

10. The system of claim 8, further comprising a storage device, and wherein the controller is further configured to store coefficients of the adaptive filter responsive to determining the convergence state of the ANC system.

11. The system of claim 8, wherein generating the cancellation signal comprises estimating a transfer function from the one or more acoustic transducers to a user's ear.

12. The system of claim 8, wherein the ANC system is implemented in a vehicle.

13. The system of claim 8, wherein the feedback signal comprises an audio signal component representative of music or speech.

14. One or more machine-readable storage devices having encoded thereon computer readable instructions for causing one or more processing devices to perform operations comprising:

receiving an input signal captured by one or more first sensors, the input signal representative of an undesired acoustic noise in a region;

processing the input signal, using one or more processing devices, to generate a cancellation signal;

generating, based on the cancellation signal, an output signal for one or more acoustic transducers, the output signal configured to cause the acoustic transducers to cancel, at least in part, the undesired acoustic noise in the region;

receiving a feedback signal captured by one or more second sensors in vicinity of the region, the feedback signal at least in part representative of residual acoustic noise in the region;

determining a characteristic of the feedback signal;

determining a characteristic of the cancellation signal;

determining a characteristic of a combination of the cancellation signal and the feedback signal; and comparing one or more thresholds to a ratio of (i) the characteristic of the combination of the cancellation signal and the feedback signal and (ii) a combination of the characteristic of the feedback signal and the characteristic of the cancellation signal, the comparison determining a convergence state, wherein at least one of the characteristic of the combination of the cancellation signal and the feedback signal, the characteristic of the feedback signal, or the characteristic of the cancellation signal comprises a power spectral density.

15. The one or more machine-readable storage devices of claim 14 having encoded thereon computer readable instructions for causing the one or more processing devices to perform operations comprising:

applying an adaptive filter to the input signal to generate the cancellation signal.

16. The one or more machine-readable storage devices of claim 14, wherein generating the cancellation signal comprises estimating a transfer function from the one or more acoustic transducers to a user's ear.

17. The one or more machine-readable storage devices of claim 14, wherein the one or more first sensors are disposed outside of a cabin of the vehicle.

* * * * *